US005568588A

United States Patent [19]

Bialik et al.

[11] Patent Number: 5,568,588

[45] Date of Patent: Oct. 22, 1996

[54] MULTI-PULSE ANALYSIS SPEECH PROCESSING SYSTEM AND METHOD

[75] Inventors: Leon Bialik; Felix Flomen, both of Rishon LeZion, Israel

[73] Assignee: AudioCodes Ltd., Israel

[21] Appl. No.: 236,764

[22] Filed: Apr. 29, 1994

[51] Int. Cl.[6] ..... G10L 5/06

[52] U.S. Cl. ..... 395/2.32; 395/2.3

[58] Field of Search ..... 395/2.1, 2.21, 395/2.3, 2.31, 2.32, 2.28, 2.29, 2.34

[56] References Cited

U.S. PATENT DOCUMENTS

| | | | |
|---|---|---|---|
| 4,710,959 | 12/1987 | Feldman et al. | 395/2.16 |
| 4,932;061 | 6/1990 | Kroon et al. | 395/2.32 |
| 5;007,094 | 4/1991 | Hsuen et al. | 395/2.35 |
| 5,060,269 | 10/1991 | Zinser | 381/38 |

OTHER PUBLICATIONS

*Digital Speech Processing, Synthesis and Recognition* by Sadaoki Furui, Marcel Dekker, inc., New York, NY 1989, section 6.4.2 1989.

*Primary Examiner*—Allen R. MacDonald
*Assistant Examiner*—Thomas J. Onka
*Attorney, Agent, or Firm*—Skjervan, Morrill, MacPherson, Franklin & Friel; Forrest E. Gunnison

[57] ABSTRACT

A speech processing system and method are disclosed. In one embodiment of the present invention, the system includes at least a maximum likelihood quantization (MLQ) multi-pulse analysis unit operating on a target vector. The MLQ multi-pulse analyses unit typically determines an initial gain level for the multi-pulse sequence and performs single gain multi-pulse analysis (MPA) a number of times, each with a different gain level. The pulse sequence which most closely represents the target vector is provided as an output signal. In another embodiment, the system includes at least a pulse train multi-pulse analysis unit wherein the target vector is modeled as a series of pulse trains. Each pulse train comprises a plurality of single gain pulses, wherein each pulse is at a position which is a pitch value distance apart from the previous pulse in the pulse train. Combinations of maximum likelihood analyses with pulse trains are also part of the present invention.

17 Claims, 10 Drawing Sheets

MULTI-PULSE ANALYSIS SPEECH PROCESSING SYSTEM AND METHOD

FIELD OF THE INVENTION

The present invention relates to speech processing systems generally and to multi-pulse analysis systems in particular.

BACKGROUND OF THE INVENTION

Speech signal processing is well known in the art and is often utilized to compress an incoming speech signal, either for storage or for transmission. The speech signal processing typically involves dividing the incoming speech signals into frames and then analyzing each frame to determine its components. The components are then stored or transmitted.

Typically, the frame analyzer determines the short-term and long-term characteristics of the speech signal. The frame analyzer can also determine one or both of the short- and long-term components, or "contributions", of the speech signal. For example, linear prediction coefficient analysis (LPC) provides the short-term characteristics and contribution and pitch analysis and prediction provides the long-term characteristics as well as the long-term contribution.

Typically, either, both or neither of the long- and short-term predictor contributions are subtracted from the input frame, leaving a target vector whose shape has to be characterized. Such a characterization can be produced with multi-pulse analysis (MPA) which is described in detail in section 6.4.2 of the book *Digital Speech Processing, Synthesis and Recognition* by Sadaoki Furui, Marcel Dekker, Inc., New York, N.Y. 1989. The book is incorporated herein by reference.

In MPA, the target vector, which is formed of a multiplicity of samples, is modeled by a plurality of pulses of equal amplitude (or spikes), of varying location and varying sign (positive and negative). To select each pulse, a pulse is placed at each sample location and the effect of the pulse, defined by passing the pulse through a filter defined by the LPC coefficients, is determined. The pulse which provides most closely matches the target vector is selected and its effect is removed from the target vector, thereby generating a new target vector. The process continues until a predetermined number of pulses have been found. For storage or transmission purposes, the result of the MPA analysis is a collection of pulse locations and a quantized value of the gain.

The gain is typically determined from the first pulse which is determined. This gain is then utilized for the remaining pulses. Unfortunately, the gain value of the first pulse is not always indicative of the overall gain value of the target vector and therefore, the match to the target vector is not always very accurate.

SUMMARY OF THE PRESENT INVENTION

It is therefore an object of the present invention to provide an improved speech processing system. In one embodiment of the present invention, the system includes a short-term analyzer, a target vector generator and a maximum likelihood quantization (MLQ) multi-pulse analysis unit. The short-term analyzer determines the short-term characteristics of an input speech signal. The target vector generator generates a target vector from at least the input signal. The MLQ multi-pulse analysis unit operates on the resultant target vector.

The MLQ multi-pulse analysis unit typically determines an initial gain level for the multi-pulse sequence and performs single gain MPA a number of times, each with a different gain level. The gain levels are within a range above and below the initial gain level. The resultant pulses can be positive or negative.

Like in other maximum likelihood applications, the quality of the result is measured (in this case, by minimizing the energy of an error vector defined as the difference between the target vector and an estimated vector produced by filtering the single gain pulse sequence through a perceptual weighting filter). The pulse sequence which minimizes the energy of the error vector and its corresponding gain level (or the index for the gain level) is then provided as the output signal of the MLQ multi-pulse analysis unit.

In an alternative embodiment, the system includes a long-term prediction analyzer and replaces the MLQ multi-pulse analysis unit with a pulse train multi-pulse analysis unit. In this embodiment, the pulse train multi-pulse analysis unit utilizes a pitch distance from the long-term analyzer to create a train of equal amplitude, same sign pulses, each the pitch distance apart from the previous pulse in the train. The multi-pulse analysis unit then outputs a signal representing the sequence of pulse trains, including positive and negative pulse trains, which best represents the target vector.

In a further alternative embodiment, the system includes an MLQ pulse train multi-pulse analysis unit which combines the operations of the two previous embodiments. In other words, a range of gains are provided, and for each, a sequence of pulse trains is found. The sequence which represents the closest match to the target vector is provided as the output signal.

In a final further embodiment, the output of the maximum likelihood and pulse train multi-pulse analysis units are compared and the sequence which represents the closest match to the target vector is provided as the output signal.

BRIEF DESCRIPTION OF THE DRAWINGS

The present invention will be understood and appreciated more fully from the following detailed description taken in conjunction with the drawings in which:

FIG. 2, which includes

FIG. 6, which includes

DETAILED DESCRIPTION OF PREFERRED EMBODIMENTS

Figure 1:
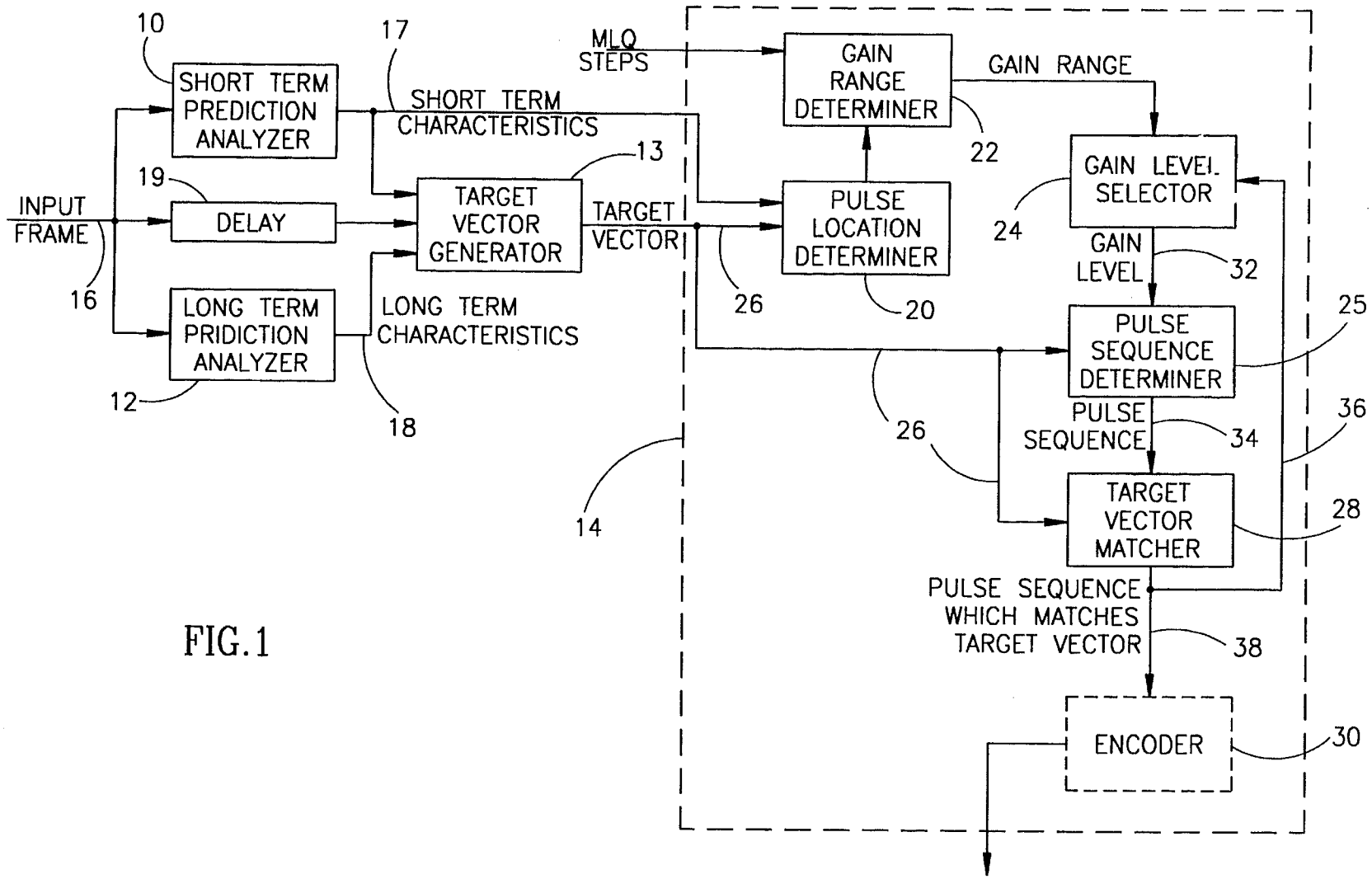
FIG. 1 is a block diagram illustration of a first embodiment of the speech processing system of the present invention.

Reference is now made to FIGS. 1, 2, 3A and 3B which illustrate a first embodiment of the present invention. The speech processing system of the present invention includes at least a short-term prediction analyzer 10, a long-term prediction analyzer 12, a target vector generator 13 and a maximum likelihood quantization multi-pulse analysis (MP-MLQ) unit 14.

Short-term prediction analyzer 10 receives, on input line 16, an input frame of a speech signal formed of a multiplicity of digitized speech samples. Typically, there are 240 speech samples per frame and the frame is often separated into a plurality of subframes. Typically, there are four subframes, each typically 60 samples long. The input frame can be a frame of an original speech signal or of a processed version thereof.

Short-term prediction analyzer 10 also receives, on input line 16, the input frame and produces, on output line 17, the short-term characteristics of the input frame. In one embodiment, analyzer 10 performs linear prediction analysis to produce linear prediction coefficients (LPCs) which characterize the input frame.

For the purposes of the present invention, analyzer 10 can perform any type of LPC analysis. For example, the LPC analysis can be performed as described in chapter 6.4.2 of the book *Digital Speech Processing, Synthesis and Recognition,* as follows: a Hamming window is applied to a window of 180 samples centered on a subframe. Tenth order LPC coefficients are generated, using the Durbin recursion method. The process is repeated for each subframe.

Long-term predictor analyzer 12 can be any type of longsterm predictor and operates on the input frame received on line 16. Long-term analyzer 12 analyzes a plurality of subframes of the input frame to determine the pitch value of the speech within each subframe, where the pitch value is defined as the number of samples after which the speech signal approximately repeats itself. Pitch values typically range between 20 and 146, where 20 indicates a high-pitched voice and 146 indicates a low-pitched voice.

For example, for every two subframes, a pitch estimate can be determined by maximizing a normalized cross-correlation function of the subframes s(n), as follows:

$$C_i=\frac{\Sigma s(k)s(k-i)}{\Sigma s(k-i)s(k-i)},\ 0\leqq k\leqq 119,\ 20\leqq i\leqq 146 \quad (1)$$

For this example, long-term analyzer 12 selects the index i which maximizes cross-correlation C_i as the pitch value or the two subframes.

Once the long-term analyzer 12 determines the pitch value, the pitch value is utilized to determine the long-term prediction information for the subframe, provided on output line 18.

The target vector generator 13 receives the output signals of the long-term analyzer 12 and the short-term analyzer 10 as well as the input frame on input line 16, via a delay 19. In response to those signals, target vector generator 13 generates a target vector from at least a sub frame of the input frame. The long- and short-term information can be utilized, if desired, or they can be ignored. The delay 19 ensures that the input frame which arrives at the target vector corresponds to the output of the analyzers 10 and 12.

An output line 26 of target vector generator 13, which is connected to the MP-MLQ unit 14, carries the target vector output signal. The MP-MLQ unit 14 is typically also connected to output line 17 carrying the short-term characteristics produced by analyzer 10.

It will be appreciated that, without any loss of generality, the target vector to the MP-MLQ unit 14 can be produced in any other desired manner.

Figure 2A:
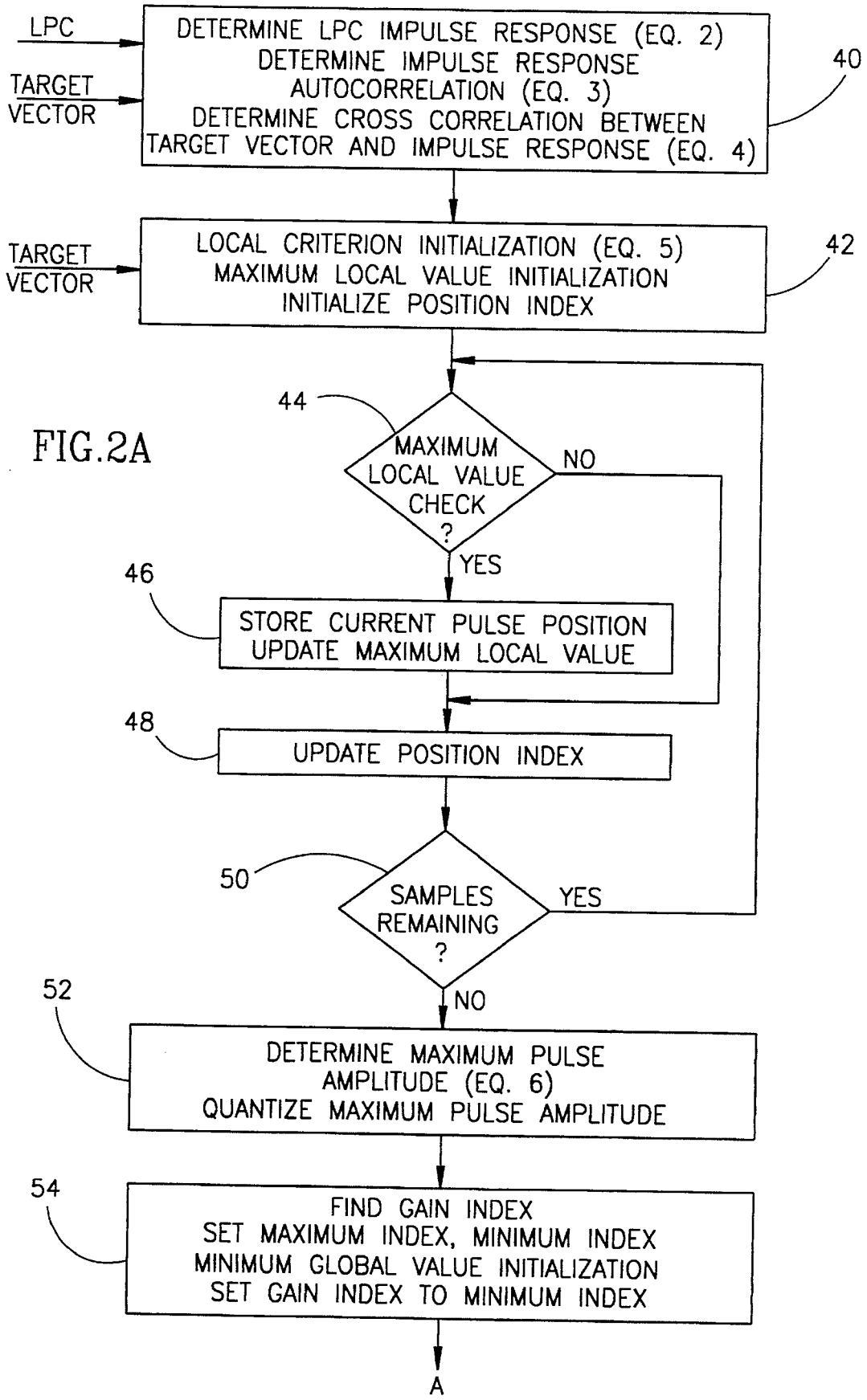
FIGS. 2A, 2B and 2C, is a flow chart illustration of the operations of an Multi-Phase Maximum Likelihood Quantization (MP-MLQ) block of FIG. 1.
Figure 2B:
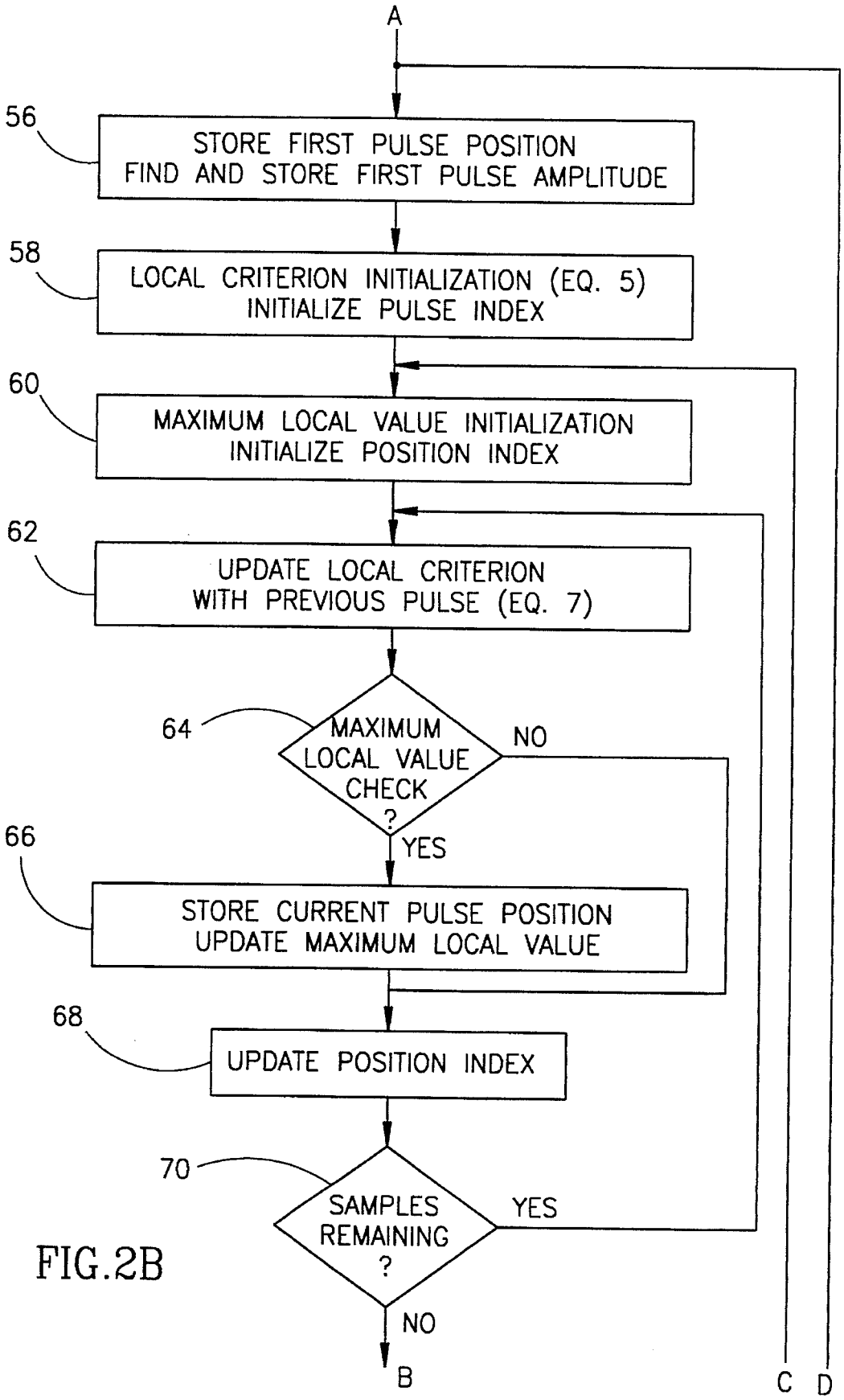
Figure 2C:
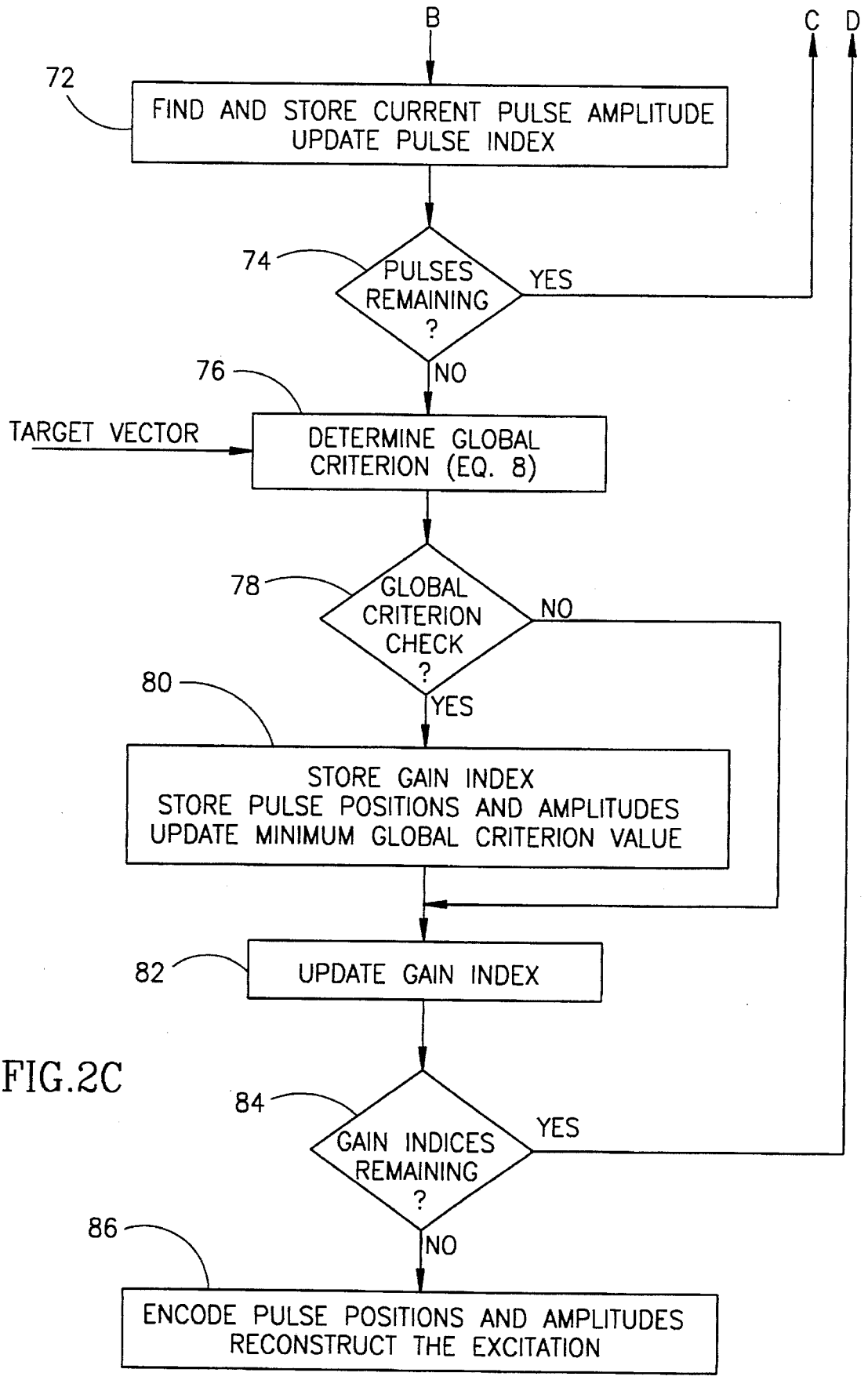

In accordance with the first preferred embodiment of the present invention, the MP-MLQ unit 14 includes an initial pulse location determiner 20, a gain range determiner 22, a gain level selector 24, a pulse sequence determiner 25, a target vector matcher 28 and an optional encoder 30. The specific operations performed by elements 20–30 are illustrated in FIG. 2 and are described in detail hereinbelow. The following is a general description of the operation of unit 14.

The initial pulse location determiner 20 receives the output signals of the target vector generator 13 and the short-term analyzer 10 along output lines 17 and 26, respectively. It determines the sample location of a first pulse in accordance with multi-pulse analysis techniques.

The gain range determiner 22 receives the first pulse output of unit 20 and determines both an amplitude of the first pulse and a range of quantized gain levels around the absolute value of the determined amplitude. The step size, labeled MLQ_STEPS, for moving through the range of quantized gain levels, typically has a value of 3 separate gain levels. The step size, MLQ_STEPS, is not determined by MP_MLQ unit 14.

The gain level selector 24 receives the gain range produced by gain range determiner 22 and moves through the gain values within the gain range. Its output, on output line 32, is a current gain level for which sequence of equal amplitude pulses is to be determined.

The pulse sequence determiner 25 receives the target vector, on line 26, and the current gain level, on line 32, and determines therefrom, using multi-pulse analysis techniques as described hereinbelow, a pulse sequence (with both positive and negative pulses) which matches the target vector. The pulse sequence is a series of positive and negative pulses having the current gain level.

The target vector marcher 28 receives the pulse sequence output, on output line 34, of determiner 25, and the target vector, on output line 26. Marcher 28 determines the quality of the match by utilizing a maximum likelihood type criterion.

Since there are a range of gain levels, the matcher 28 returns control to the gain level selector 24 to select the next gain level. This return of control is indicated by arrow 36.

For each gain value, matcher 28 determines the quality of the match, saving the match (gain index and pulse sequence) only if it provides a smaller value for the criterion than previous matches.

Once gain selector 24 has moved through all of the gain values, the gain index and pulse sequence which is in storage in matcher 28 is the closest match to the target vector. Matcher 28 then outputs the stored pulse sequence and gain index along output line 38 to optional encoder 30.

It will be appreciated that, by determining a pulse sequence for each of a few gain levels, the MP-MLQ unit 14 can select the one which most closely matches the target vector.

Optional encoder 30 encodes the output pulse sequence and gain index for storage or transmission.

The specific operations of the MP-MLQ unit 14 are shown in FIG. 2. In initialization step 40, unit 14 generates the following signals:

a) an impulse response h[n] for the input frame from the short-term characteristics a_i defined as:

$$h[n]=\Sigma a_i*h[n-i]+\delta[n],\ 0\leqq n\leqq N-1,\quad 1\leqq i\leqq P\ h[-n]=0, n=1\ldots P \quad (2)$$

where P is the number of short-term characteristics and N is the number of speech samples in the subframe b) the result r_hh[l] of an impulse response autocorrelation, for each sample position l, as follows:

$$r_hh[l]=\Sigma h[n]*h[n-l],\ 0\leqq l\leqq N-1,\ 1\leqq n\leqq N-1 \quad (3)$$

and c) the result r_th[l] of a cross-correlation between the impulse response h[n] and the target vector t[n], for each sample position l, as follows:

$$r_th[l]=\Sigma t[n]*h[n-l,\ 0\leqq l\leqq N-1,\ 1\leqq n\leqq N-1 \quad (4)$$

It will be appreciated that the impulse response is a function of the short-term characteristics a_i provided along line 17 from analyzer 10. The impulse response generated in initialization step 40 corresponds to the Durbin LPC analysis mentioned hereinabove.

The MP-MLQ unit 14 utilizes a local criterion LC_kj[l] to determine a quantitative value for each sample position l, each pulse k and each gain level j. As will be seen hereinbelow, the level of the local criterion is dependent on the value of k (i.e. on the number of pulses already determined).

In step 42, the local criterion LC_0,j[l] for the first pulse determination is initialized to the cross-correlation function r_th[l], as follows:

$$LC_0[l]=LC_0,j[l]=r_th[l],\ 0\leqq l\leqq N-1,\ j_min\leqq j\leqq j_max \quad (5)$$

A maximum local value for the local criterion is also set to some negative value. The position index l is also initialized to 0.

In steps 44–50 the position l of the first pulse k=1 is determined. To do so, the absolute value of the local criterion LC_0,j[l] is compared to the maximum local value (step 44). If LC_0,j[l] is larger, the position l is stored, the maximum local value is set to the absolute value of the local criterion LC_0,j[l] (step 46) and the position index l is increased by 1 (step 48). The operation is repeated until all the positions l have been reviewed. The sample position l_opt which is in storage after all of the positions have been reviewed is the selected sample position l_opt. Steps 40–50 are performed by the pulse location determiner 20.

Step 52 is performed by the gain range determiner 22. In step 52, maximum amplitude A_max of the position l which produced the largest local criterion LC_0,j[l] is generated as follows:

$$A_max=A_max_j=|LC_0,\ j[l_opt]|/r_hh[0],\ j_min\leqq j\leqq j_max \quad (6)$$

where l_opt is the position of the first pulse. The maximum value A_max is then approximated by one of a predetermined set of gain levels. For example, if the expected amplitude levels are in the range of 0.1–2.0 units, the gain levels might be every 0.1 units. Thus, if A_max is 0.756, it is quantized to 0.8.

Steps 54–58 are performed by the gain selector 24. In step 54, gain selector 24 determines the gain index j associated with the determined gain level as well as a range of gain indices around gain index j. The range of gain levels can be any size depending on the predetermined value of MLQ_STEPS. In step 54, the gain selector 24 sets the gain index to the minimum one. For the previous example, 0.1 might have an index 1 and MLQ_STEPS might be 3. Thus, the determined gain index is 8 and the range is between indices 5–11. Step 54 also sets a minimum global value to any very large value, such as $10^{13}$.

In the present invention, for each gain index, the first pulse is the location of the pulse determined by the pulse location determiner 20 (in steps 44–50). The remaining pulses can be anywhere else within the subframe and can have positive or negative gain values. In step 56, the gain selector 24 stores the first pulse position and its amplitude. In step 58, the local criterion LC_k,j[l], for the present pulse index k and gain index j is initialized, typically in accordance with equation 5.

Pulse sequence determiner 25 performs steps 60–74. In step 60, determiner 25 sets the maximum local value to a large value, as before, and sets the position index l to 0.

In step 62, determiner 25 updates the local criterion with the previous pulse, as follows:

$$LC_k,j[l]=LC_k-1,j[l]-A_k-1,\ j*r_hh[l-l_opt_k-1,j], \quad (7)$$

j=gain index k=pulse index l=position index

In the loop of steps 64–70, pulse sequence determiner 25 determines the location of a pulse in a manner similar to that performed in steps 44–50 and therefore, will not be further described herein. In step 72, determiner 25 stores the selected pulse and in step 74, it updates the pulse value. Steps 62–74 are repeated for each pulse in the sequence, the result of which is the pulse sequence output of pulse sequence determiner 25. It is noted that step 62 updates the local criterion for each pulse which is found.

Figure 3A:
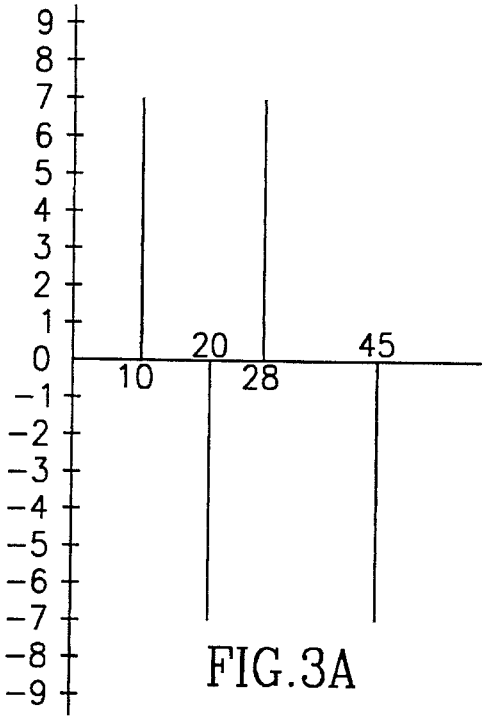
FIGS. 3A and 3B are graphical illustrations, useful in understanding the operations of FIG. 2.
Figure 3B:
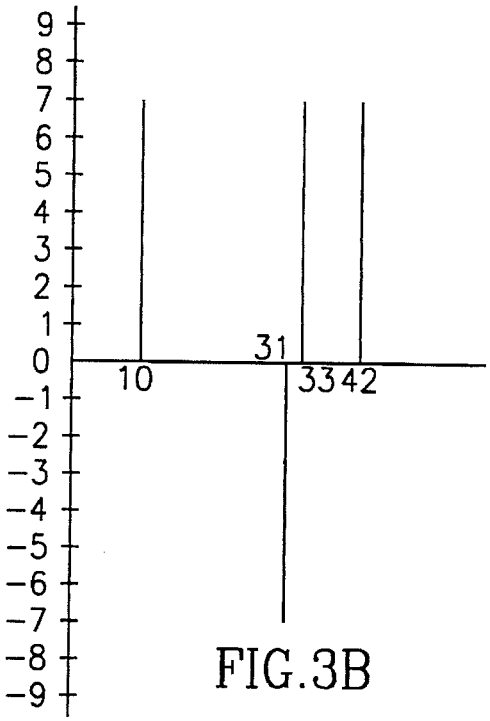

FIGS. 3A and 3B illustrate two examples of different pulse sequence outputs or pulse sequence determiner 25. The sequence of FIG. 3A has a gain index of 7 and the sequence of FIG. 3B has a gain index of 8. Both sequences have the same first sample position 10 but the rest of the pulses are at other positions. It is noted that the pulses can be positive or negative.

In step 76, target vector matcher 28 determines the value of a global criterion GC_j for each gain level j. The global criterion GC_j can be any appropriate criterion and is typically a maximum likelihood type criterion. For example, the global criterion can measure the energy in an error vector defined as the difference between the target vector and an estimated vector produced by filtering the single gain pulse sequence through a perceptual weighting filter, in this case defined by the short-term characteristics. For such a criterion, target vector matched 28 includes a perceptual weighting filter.

It will be appreciated that the pulse sequence, per se, does not match the target vector; the pulse sequence represents a function which matches the target vector.

As given in equations 8a–8e hereinbelow, the global criterion GC_j is comprised of two elements, p_j and d_j, both of which are functions of a signal x_j[n] which is the pulse series for the gain level j filtered by the short-term impulse response h[n]. P_j is the cross-correlation between the target vector t[n] and x[n] and d_j is the energy of x_j[n].

$$GC_j=-2p_j+d_j \quad (8a)$$

$$p_j=\Sigma t[n]*x_j[n],\ 0\leqq n\leqq N-1 \quad (8b)$$

$$d_j=\Sigma x_j[n]*x_j[n],\ 0\leqq n\leqq N-1 \quad (8c)$$

$$x_j[n]=\Sigma v_j[i]*h[i-n],\ 0\leqq i\leqq n,\ 0\leqq n\leqq N-1 \quad (8d)$$

$$v_j[n]=(A_k,j\ for\ n=l_opt_\ k,j,\ 0\leqq k\leqq K-1,\ 0\leqq n\leqq N-1\ (0,\ otherwise \quad (8e)$$

In step 78, the global criterion GC_j for the present gain index j is compared to the present minimum global value. If it is less than the present minimum global value, as checked in step 78, the target vector matcher 28 stores (step 80) the gain index and its associated pulse sequence.

In step 82, the gain level selector 24 updates the gain index and, in step 84 it checks whether or not pulse sequences have been determined for all of the gain levels. If so, the pulse sequence and gain index which are in storage are the ones which best match the target vector in accordance with the global criterion GC_j.

In step 86, optional encoder 30 encodes the pulse sequence and gain index as output signals, for transmission or storage, in accordance with any encoding method. If desired, the target vector can be reconstructed using x_jopt [n], where jopt is the gain index resulting from step 84.

It will be appreciated that the MP-MLQ unit 14 of the present invention provides, as output signals, at least the selected pulse sequence and the gain level.

Figure 4A:
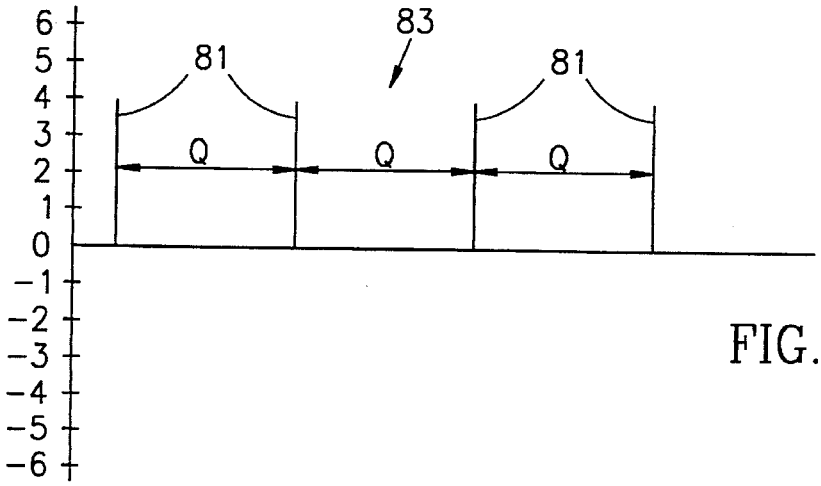
FIGS. 4A and 4B are graphical illustration describing pulse trains and multi-pulse analysis using pulse trains, respectively.

Reference is now made to FIGS. 4A, 4B, 5 and 6 which illustrate an alternative embodiment of the present invention which utilizes pulse trains. A pulse train 83 is illustrated in FIG. 4A. It comprises a series of pulses 81 separated by a distance Q which is the pitch.

Figure 4B:
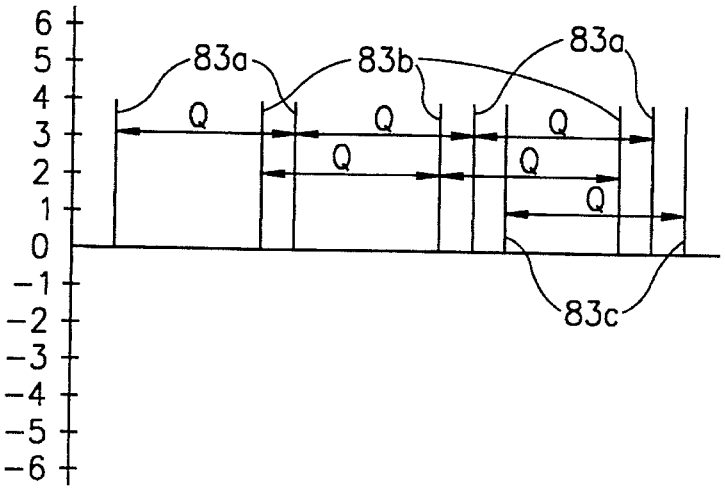
Figure 5:
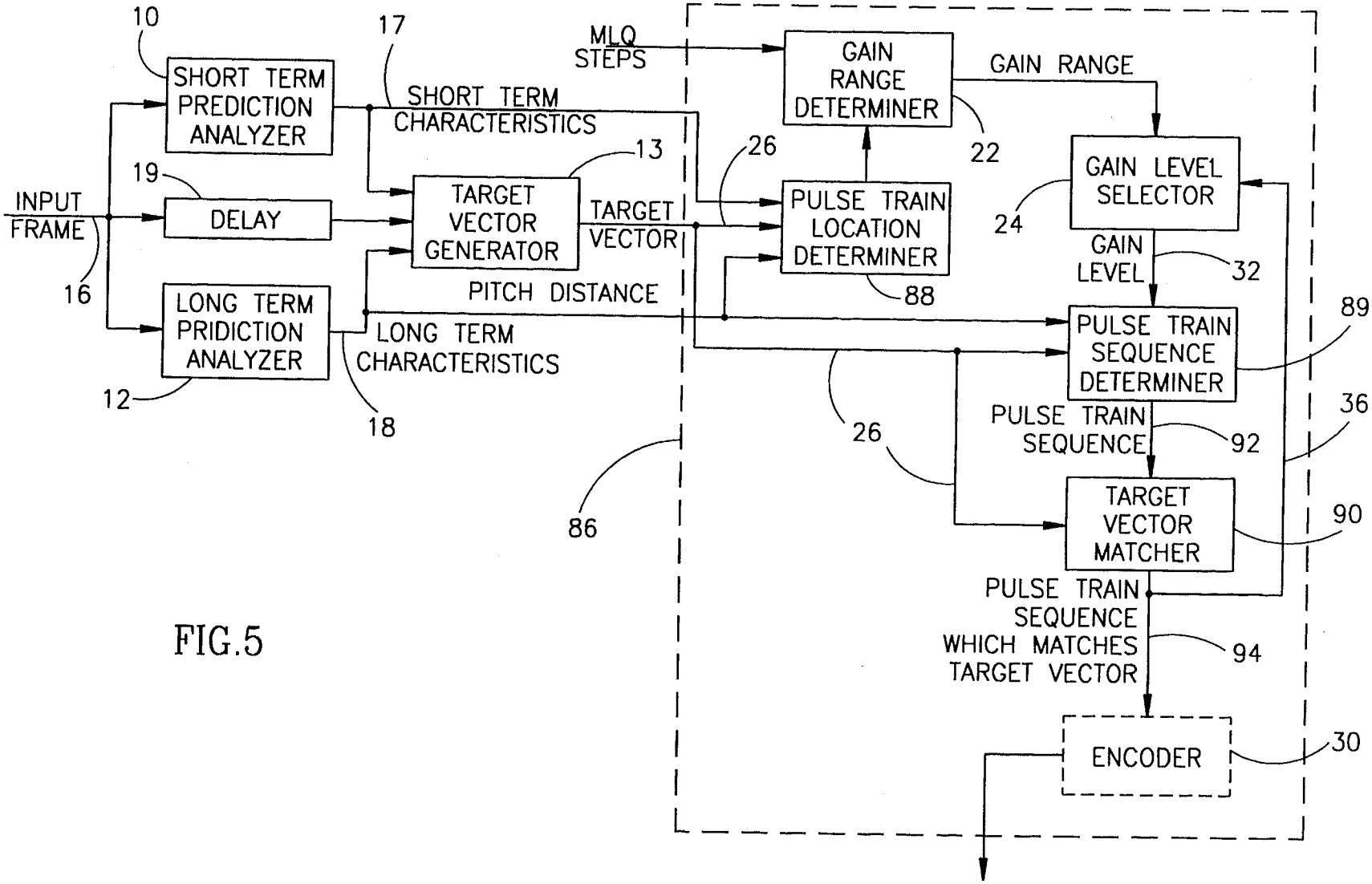
FIG. 5 is a block diagram illustration of a second embodiment of the speech processing system of the present invention utilizing pulse trains.

In the system shown in FIG. 5, a sequence of pulse trains are found which most closely match a target vector. FIG. 4B illustrates an example sequence of three pulse trains 83*a*, 83*b* and 83*c* which might be found. Each pulse train 83 begins at a different sample position. Pulse train 83*a* is the first and comprises four pulses. Pulse train 83*b* begins at a later position and comprises three pulses and pulse train 83*c*, starting at a much later position, comprises only two pulses.

The system of FIG. 5 is similar to that of FIG. 1; the only differences being that a) the pulse location determiner 20 and pulse sequence determiner 25 of FIG. 1 are replaced by pulse train location determiner 88 and pulse train sequence determiner 89; b) the target vector matched, labeled 90, operates on pulse train sequences rather than pulse sequences; and c) the determiners 88 and 89 receive the pitch value Q along output line 18. In addition, the output lines 34 and 38 are replaced by output lines 92 and 94 which carry signals representing sequences of pulse trains rather than sequences of pulses.

Pulse train determiner 88 operates similar to pulse determiner 20 except that determiner 88 utilizes a pulse train impulse response h_T[n] rather the pulse impulse response h[n]. h_T[n] is defined as:

$$h_T[n]=\Sigma h[n-k-Q],\ 0\leqq n\leqq N-1,\ 0\leqq k\leqq\lfloor(N-1)/Q\rfloor \tag{9}$$

where Q ks the pitch value. As can be seen, the pulse trains at later positions typically have fewer pulses.

The pulse train impulse response autocorrelation of equation 3 becomes:

$$r_hh[l]=\Sigma h_T[n]*h_T[n-1],\ 0\leqq 1\leqq N-1,\ 1\leqq n\leqq N-1 \tag{10}$$

and the cross-correlation r_th[1] between the impulse response h_T[n] and the target vector t[n], for each sample position l, becomes:

$$r_th[l]=\Sigma t[n]*h_T[n-l],\ 0\leqq 1\leqq N-1,\ 1\leqq n\leqq N-1 \tag{11}$$

Pulse train sequence determiner 89 operates similarly to pulse sequence determiner 25 but determiner 89 generates pulse train sequences.

Target vector matcher 90 operates similarly to target vector marcher 28; however, matcher 90 utilizes the pulse train impulse response function h_T[n] rather than h[n]. Thus, equation 8*d* becomes:

$$x_j[n]=\Sigma v_j[i]*h_T[i-n],\ 0\leqq i\leqq n,\ 0\leqq n\leqq N-1 \tag{12}$$

Figure 6A:
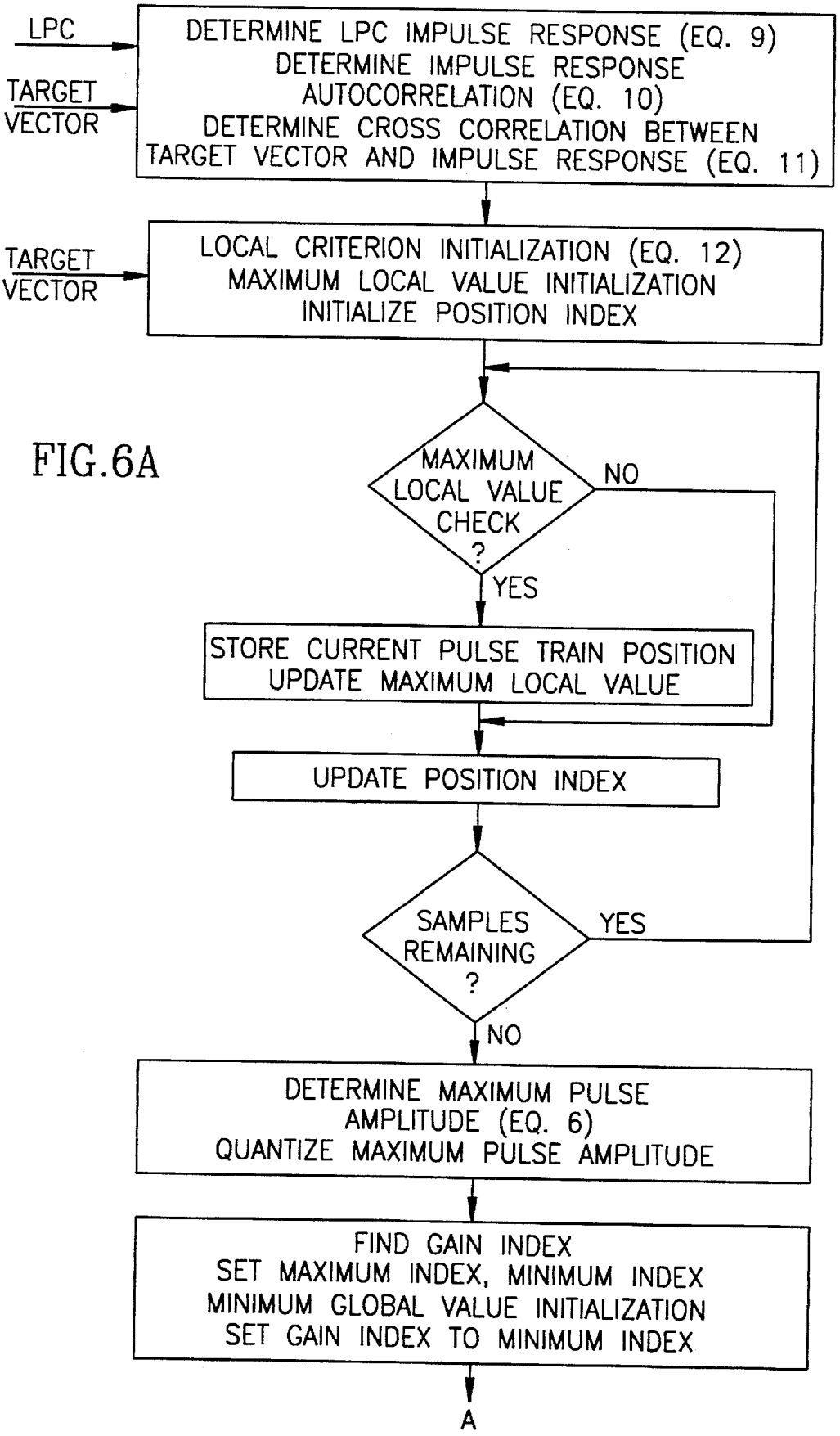
FIGS. 6A, 6B and 6C, is a flow chart illustration of the operations of the pulse train multi-pulse analysis unit of FIG. 5.
Figure 6B:
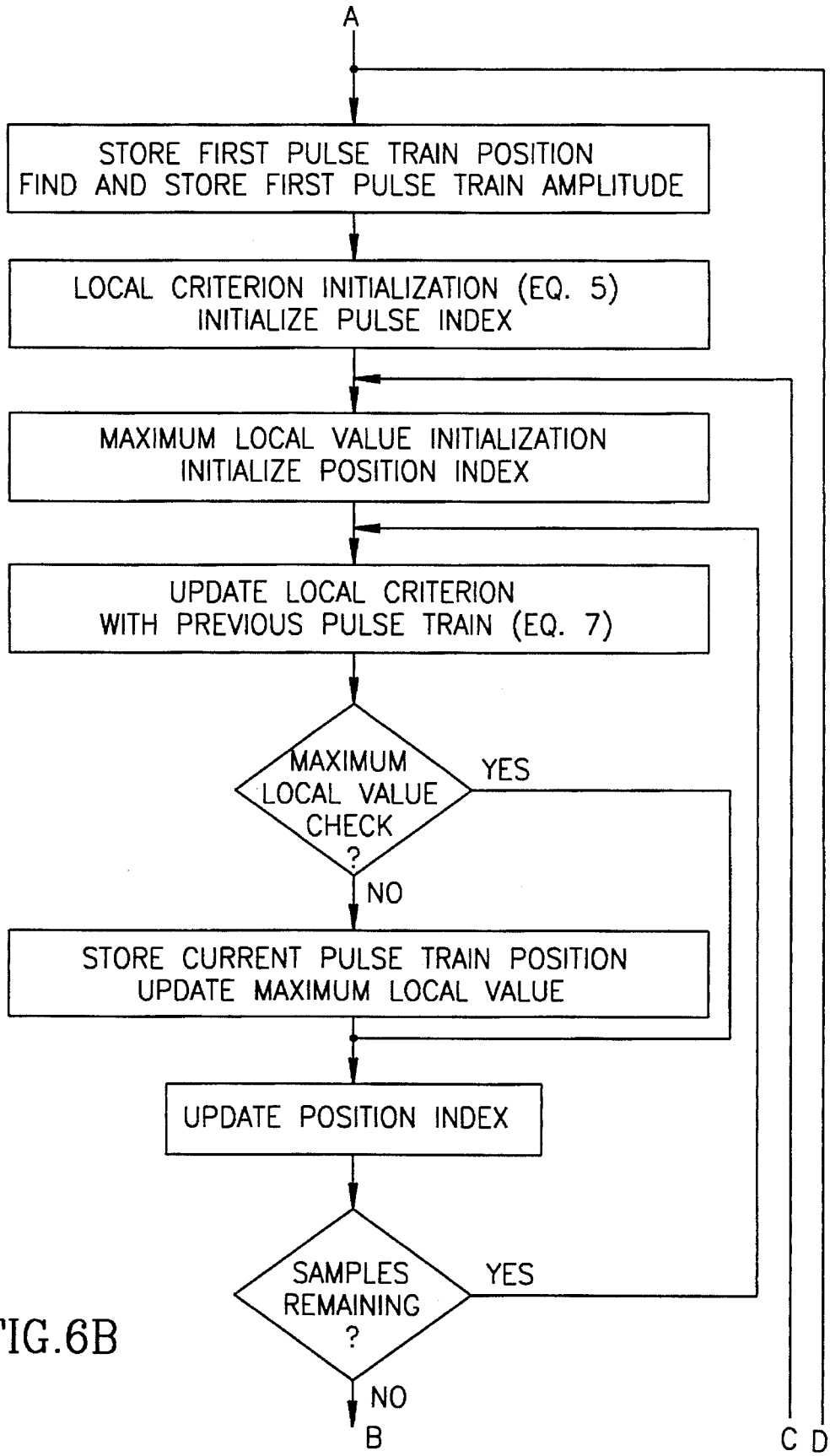
Figure 6C:
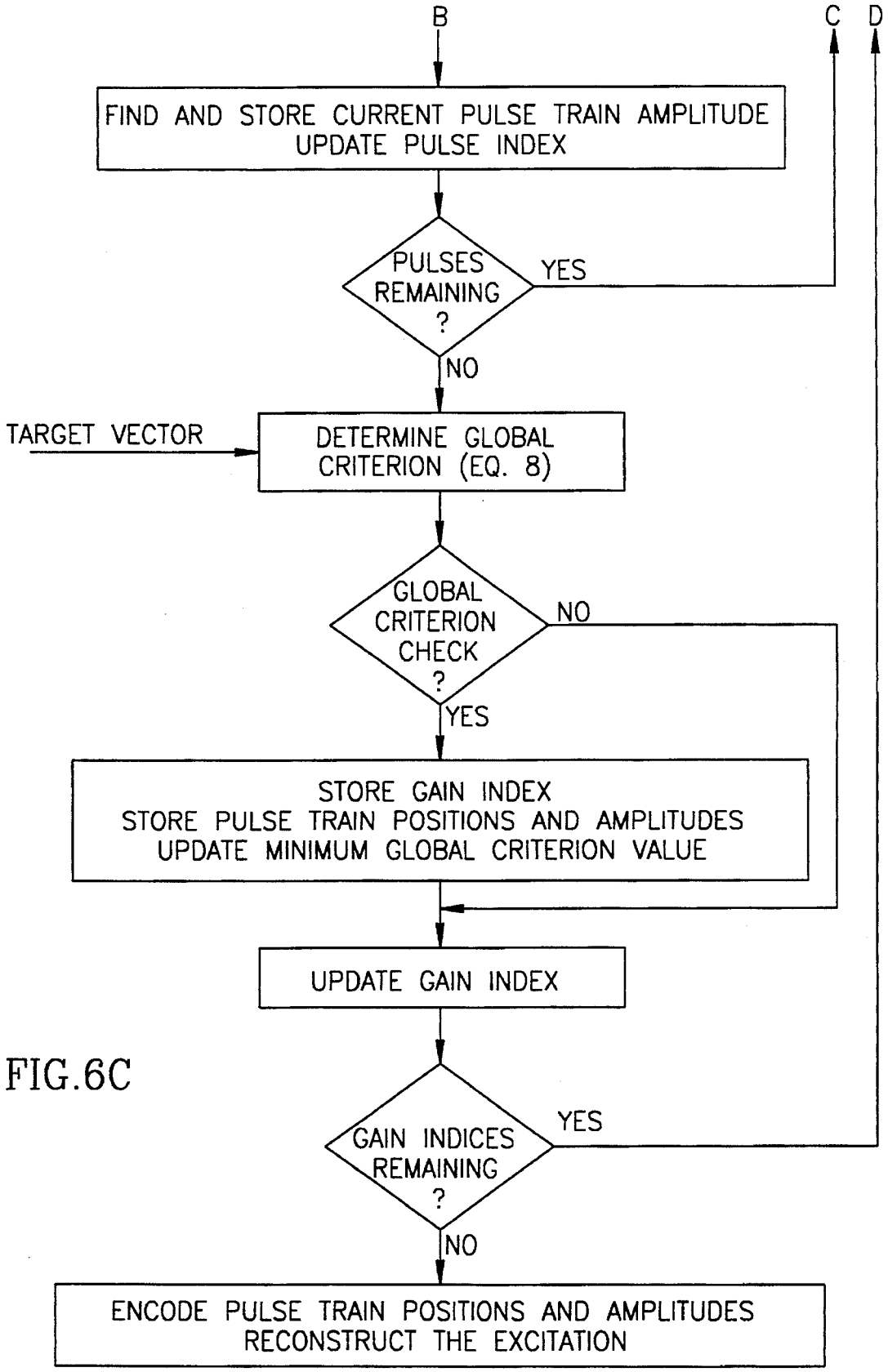

The specific operations of the pulse train multi-pulse analysis unit 86 are shown in FIG. 6. The steps are equivalent to those shown in FIG. 2; however, the equations operate on pulse trains rather than individual pulses. Thus, in equation 9, a pulse train impulse response h_T[n] is defined which has pulses every Q steps. The pulse trains at later positions typically have fewer pulses.

The remaining equations are similar except that they operate on the impulse response h_T[n].

If it is desired, the gain range determined by gain range determiner 22 can have only one gain index. In this embodiment, pulse train multi-pulse analysis unit 86 determines the pulse train sequence which has the gain level of the first pulse train sequence. In this embodiment, the target vector marcher 90 does not operate, nor is there any repeating of the operations of gain level selector 24 and pulse train sequence determiner 89.

Figure 7:
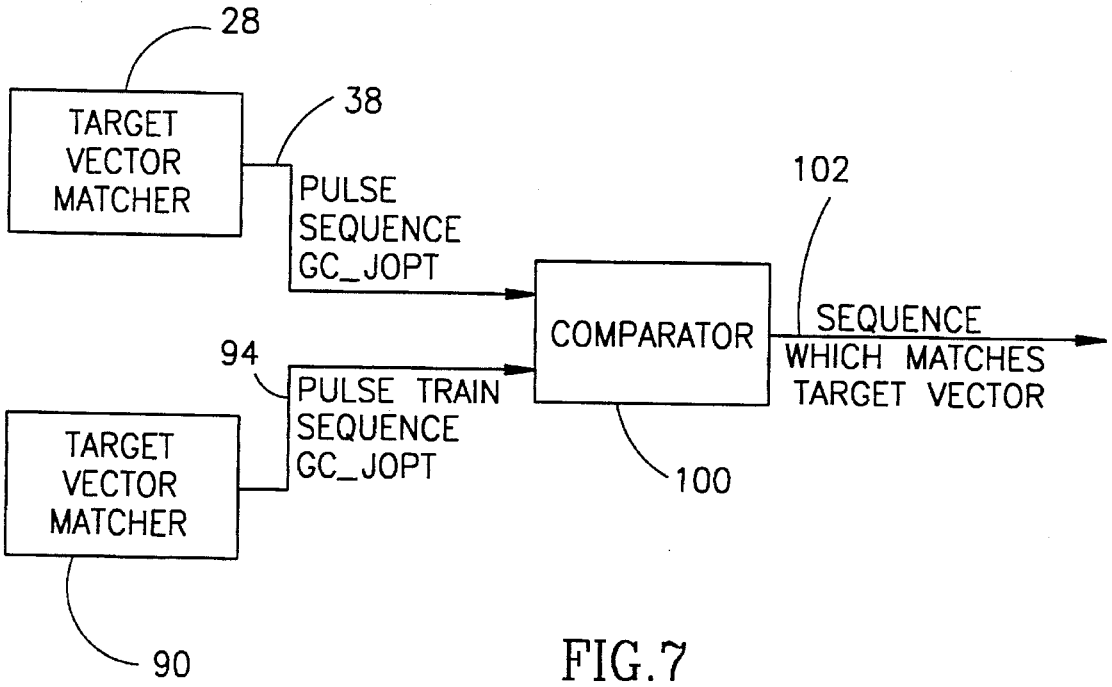
FIG. 7 is a block diagram illustration of a third embodiment comparing the output of the systems of FIGS. 1 and 5.

It will further be appreciated that the output of target vector matchers 28 and 90 can be compared. This is illustrated in FIG. 7 to which reference is now made. The output signals of marchers 28 and 90, representing the sequences and global criteria, are provided, along output lines 38 and 94 to a comparator 100. Comparator 100 compares global criteria GC_jopt from matchers 28 and 90 and selects the lowest one. An output signal representing the resulting sequence, pulse or pulse train, is provided along output line 102.

It will be appreciated that the systems of FIGS. 1, 5 and 7 can be implemented on a digital signal processing chip or in software. In one embodiment, the software was written in the programming language $C_{++}$, in another in Assembly language.

It will be appreciated by persons skilled in the art that the present invention is not limited to what has been particularly shown and described hereinabove. Rather the scope of the present invention is defined only by the claims which follow:

We claim:

1. A speech processing system comprising:

a short-term analyzer connected to an input and an output line wherein, in response to an input speech signal on said input line, said short-term analyzer generates short-term characteristics of said input speech signal;

a target vector generator for generating a target vector from at least said input speech signal and, optionally, said short-term characteristics; and a multi-pulse analyzer connected to an output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputting a signal corresponding to the sequence of equal amplitude, variable sign, variably spaced pulses which, according to a maximum likelihood criterion, most closely represents said target vector.

2. A speech processing system incorporating a short term analyzer for generating short term characteristics utilizing linear prediction coefficient analysis on an input speech signal, comprising:

a target vector generator for generating a target vector from at least said input speech signal and, optionally, the short term characteristics;

an initial pulse location determiner for determining the location of an initial pulse in accordance with multi-pulse analysis techniques, based on said target vector and the short term characteristics;

an amplitude range determiner for determining both an amplitude of said initial pulse and a range of quantized amplitude levels grouped around the absolute value of said said selected quantized amplitude, a sequence of equal amplitudes, variable sign, variably spaced pulses which corresponds to said target vector; and a target vector matcher for determining an error vector corresponding to the quality of the match between said sequence of equal amplitude, variable sign, variably spaced pulses and said target vector, for determining said error vector for each of said selected amplitudes, for outputting said sequence of equal amplitude, variable sign, variably spaced pulses that corresponds to a minimum error vector.

3. The system according to claim 2 wherein the initial pulse of each of said sequences of equal amplitudes, variable sign, variably spaced pulses is located at the same sample position.

4. The system according to claim 2 wherein said target vector matcher includes a global criterion determiner, said global criterion determiner includes a perceptual weighting filter for filtering said sequence of equal amplitude, variable sign, variably spaced pulses and a determiner for determining the amount of energy in said error vector, for each of said selected quantized amplitudes, said error vector defined as the difference between said target vector and the output of said filter, said perceptual weighting filter having characteristics corresponding to the short term characteristics. amplitude, uniformly spaced pulses.

5. A speech processing system incorporating a short term analyzer for generating short term characteristics utilizing linear prediction coefficient analysis from an input speech signal and incorporating a long term analyzer for determining long term characteristics and a pitch value of speech from the input speech signal, the system comprising:

a target vector generator for generating a target vector from at least said input speech signal and, optionally, the short term and long term characteristics;

an initial pulse train location determiner for determining the location of an initial pulse train in accordance with multi-pulse analysis techniques, based on said target vector, the short term characteristics and the pitch value; and a pulse train sequence determiner for generating a plurality of variable sign trains of equal amplitude, uniformly spaced pulses which corresponds to said target vector, said pulses within said trains having a pulse spacing corresponding to the pitch value, said pulses within each train having the same sign, and said pulses of all of said trains having the same amplitude level.

6. A speech processing system comprising:

a long-term analyzer connected to an input and an output line wherein, in response to an input speech signal on said input line, said long-term analyzer generates long term characteristics including at least a pitch value of said input speech signal;

a short-term analyzer connected to said input line and to an output line wherein, in response to said input speech signal on said input line, said short-term analyzer generates short-term characteristics of said input speech signal;

a target vector generator for generating a target vector from at least said input speech signal and, optionally the short term and long term characteristics; and a pulse train multi-pulse analyzer, connected to an output line of said target vector generator for generating a plurality of sequences of variable sign trains of equal amplitude, uniformly spaced pulses, said pulses within each train having the same sign, and each of said sequences of trains of pulses having a different amplitude value said pulse train multi-pulse analyzer outputting a signal corresponding to the plurality of trains of equal amplitude, uniformly spaced pulses which, in accordance with a maximum likelihood criterion, most closely represents said target vector.

7. The system according to claim 6 wherein each of said pulses within each said train of pulses is separated from each other by said pitch value.

8. The system according to claim 6 wherein the initial pulse of the initial train of each said sequence of trains of pulses is located at the same sample position.

9. The system according to claim 6 further comprising:

a multi-pulse analyzer connected to said output line of said target vector generator, wherein said multi-pulse analyzer generates a plurality of sequences of equal amplitude, variable sign, variably spaced pulses, each of said sequences having a different amplitude value, each of said pulses within each sequence having equal amplitudes but variable signs, said multi-pulse analyzer for outputting a signal corresponding to the sequence of equal amplitude, variable signs variably spaced pulses which, according to a maximum likelihood criterion, most closely represents said target vector; and a comparator receiving output from both said pulse train multi-pulse analyzer and said multi-pulse analyzer for selecting the output which best matches said target vector.

10. A speech processing system incorporating a short term analyzer for generating short term characteristics utilizing linear prediction coefficient analysis from an input speech signal and incorporating a long term analyzer for determining long term characteristics including a pitch value of speech from the input speech signal, the system comprising:

a target vector generator for generating a target vector from at least said input speech signal and, optionally, the short term and long term characteristics;

an initial pulse train location determiner for determining the location of an initial pulse train in accordance with multi-pulse analysis techniques, based on said target vector, the short term characteristics and the pitch value;

an amplitude range determiner for determining both an amplitude of said initial pulse train and a range of quantized amplitude levels grouped around the absolute value of said amplitude;

an amplitude level selector for stepping through said range of quantized amplitude levels in accordance with a predetermined step size, said amplitude level selector outputting a selected quantized amplitude at each step;

a pulse train sequence determiner for generating, for each of said selected quantized amplitudes, a plurality of variable sign trains of equal amplitude, uniformly spaced pulses which corresponds to said target vector, said pulses within said trains having a pulse spacing corresponding to the pitch value, said pulses within each train having the same sign, said pulses within each train of pulses having an equal amplitude, said equal amplitude corresponding to said selected quantized amplitude; and a target vector matcher for determining an error vector corresponding to the quality of the match between said plurality of sequences of variable sign trains of equal amplitude, uniformly spaced pulses and said target vector, for determining said error vector for each said selected quantized amplitude, said target vector matcher for outputting said sequence of trains of equal amplitude, equal sign, uniformly spaced pulses that corresponds to a minimum error vector.

11. The system according to claim 10 wherein said target vector matcher includeds a global criterion determiner, said global criterion determiner includes a perceptual weighting filter for filtering said plurality of variable sign trains of equal amplitude, uniformly spaced pulses and a determiner for determining the amount of energy in said error vector, for each said selected quantized amplitude, said error vector defined as the difference between said target vector and the output of said filter, said perceptual weighting filter having characteristics corresponding to the short term characteristics.

12. A method of speech processing comprising the steps of:

determining short-term characteristics of an input speech signal;

generating a target vector from at least said input speech signal and, optionally from said short-term characteristics;

determining the location of an initial pulse in accordance with multi-phase analysis techniques, based on said target vector and said short-term characteristics;

determining both an amplitude of said initial pulse and a range of quantized amplitude levels groups around the absolute value of said amplitude;

stepping through said range of quantized amplitude levels in accordance with predetermined step size and outputting a selected quantized amplitude at each step;

generating, based on said selected quantized amplitude, a sequence of equal amplitude, variable sign, variably spaced pulses which corresponds to said target vector;

comparing each said sequence of equal amplitude, variable sign, variably spaced pulses to said target vector; and selecting said sequence of equal amplitude, variable sign, variably spaced pulses which, in accordance with a maximum likelihood criterion, most closely represents said target vector.

13. The method according to claim 12 wherein the initial pulse of each said sequence of equal amplitude, variable sign, variably spaced pulses is located at the same sample position.

14. The method according to claim 12 wherein said step of comparing includes the steps of:

filtering the sequence of equal amplitude, variable sign, variably spaced pulses through a perceptual weighting whose characteristics are said short-term characteristics; and determining, for each quantized amplitude level, the amount of energy in an error vector defined as the difference between said target vector and the output of said filter.

15. A method of speech processing comprising the steps of:

determining short term characteristics of an input speech signal;

determining long term characteristics of said input speech signal including at least a pitch value of said input speech signal;

generating a target vector from at least said input speech signal, and, optionally from said short term and long term characteristics;

determining the location of an initial pulse train in accordance with multi-pulse analysis techniques based on said target vector, said short term characteristics and said pitch value; and generating a plurality of variable sign trains of equal amplitude, uniformly spaced pulses which correspond to said target vector, said pulses within said trains having a pulse spacing corresponding to said pitch value, said pulses within said trains having the same amplitude level, said pulses within each train having the same sign.

16. A method of speech processing comprising the steps of:

determining short-term characteristics of said input speech signal;

determining long-term characteristics of said input speech signal including at least a pitch value of said input speech signal;

generating a target vector from at least said input speech signal, and, optionally, from said short-term and long-term characteristics;

determining the location of an initial pulse train in accordance with multi-pulse analysis techniques, based on said target vector, the short-term characteristics and the pitch value;

determining both an amplitude of said initial pulse train and a range of quantized levels grouped around the absolute value of said amplitude;

stepping through said range of quantized amplitude levels in accordance with a predetermined step size and outputting a selected quantized amplitude at each step;

generating, for each selected quantized amplitude, a plurality of variable sign trains of equal amplitude, uniformly spaced pulses which correspond to said target vector, said pulses within said trains of pulses having a pulse spacing corresponding to said pitch value, said pulses within each said train of pulses having the same amplitude, said same amplitude corresponding to the selected quantized amplitude, the pulses within each train having the same sign;

comparing said plurality of variable sign trains of equal amplitude, uniformly spaced pulses to said target vector; and selecting said plurality of variable sign trains of equal amplitude, uniformly spaced pulses which, in accordance with a maximum likelihood criterion, most closely represents said target vector.

17. The method according to claim 16 wherein the initial pulse of each said sequence of trains of pulses is located at the same sample position.

* * * * *

UNITED STATES PATENT AND TRADEMARK OFFICE

CERTIFICATE OF CORRECTION

PATENT NO. : 5,568,588
DATED : October 22, 1996
INVENTOR(S) : Bialik, Leon et al.

It is certified that error appears in the above-identified patent and that said Letters Patent is hereby corrected as shown below:

Column 9,
Line 11, after "said" (first occurrence) insert: -- amplitude; an amplitude level selector for stepping through said range of quantized amplitude levels in accordance with a predetermined step size, said amplitude level selector outputting a selected quantized amplitude at each step;
A pulse sequence determiner for generating based on said selected quantized amplitude, …
Lines 35 and 36, delete "amplitude, uniformly spaced pulses."

Column 11,
Line 37, replace "groups" with -- grouped --
Line 60, after "weighting" insert -- filter --.

Signed and Sealed this

Eleventh Day of June, 2002

*Attest:*

*Attesting Officer*

JAMES E. ROGAN
*Director of the United States Patent and Trademark Office*